US005927483A

United States Patent [19]

Yamada

[11] Patent Number: 5,927,483

[45] Date of Patent: Jul. 27, 1999

[54] SWITCH STRUCTURE OF ELECTRONIC DEVICE

[75] Inventor: Hiroshi Yamada, Kakegawa, Japan

[73] Assignee: NEC Corporation, Tokyo, Japan

[21] Appl. No.: 09/052,313

[22] Filed: Mar. 31, 1998

[30] Foreign Application Priority Data

Mar. 31, 1997 [JP] Japan ..... 9-081231

[51] Int. Cl.[6] ..... H01H 13/70

[52] U.S. Cl. ..... 200/343

[58] Field of Search ..... 200/293, 303, 200/341, 343, 5 A

[56] References Cited

U.S. PATENT DOCUMENTS 5,788,060 8/1998 Kuroda ..... 200/343

FOREIGN PATENT DOCUMENTS 7-29449 1/1995 Japan .

*Primary Examiner*—Michael L. Gellner
*Assistant Examiner*—Nhung Nguyen
*Attorney, Agent, or Firm*—Scully, Scott, Murphy & Presser

[57] ABSTRACT

This invention copes with miniaturization of an electronic device and provides a switch structure of the electronic device at inexpensive price. The switch structure of the electronic device comprises a case (an upper case 1 and a lower case 4) having supporting convex portions 4*f*, switches 3*a* mounted within the case, and a push button 2 containing arm portions 2*c* elastically deformable, push button portions 2*b*, and switch pushing convex portions 2*e* provided on an end of a surface of each push button portion. One end of each arm portion which is far from each push button portion is fixed to the case. Each supporting convex portion is provided so as to contact a position nearer each arm portion relative to a center of each push button portion, on the surface of each push button portion during the operation of each push button portion. Each switch pushing convex portion actuates each switch when the operation of each push button portion has terminated.

7 Claims, 5 Drawing Sheets

SWITCH STRUCTURE OF ELECTRONIC DEVICE

BACKGROUND OF THE INVENTION

This invention relates to a structure of a switch of an electronic device like, for example, individual call signal receiver and more particularly to a structure of a switch of an electronic device of high-density parts mounting.

Conventional switches used in electronic devices often use a structure like seen in tact switches, in which a switch designed to be turned on by being pushed down is to be pushed by a push button provided upward.

FIG. 1 shows a schematic view showing an example of a conventional electronic device switch structure. This kind of conventional switch has been disclosed in for example Japanese Unexamined Patent Publication (JP-A) No. 29449 of 1955.

A push button 11 comprises an arm portion 11*a*, a push button portion 11*b*, and a switch pushing convex portion 11*c*. A proximal portion of the arm portion 11*a* elastically deformable is fixed to a case 12. The push button portion 11*b* is disposed on a top face of an end portion of the arm portion 11*a* and the switch pushing convex portion 11*c* is provided on a bottom thereof. A tact switch 13 is provided downward of the switch pushing convex portion 11*c*.

When the push button portion 11*b* is pushed, the arm portion 11*a* is elastically deformed, so that the switch pushing convex portion 11*c* comes into contact with the tact switch 13. If the arm portion 11*a* is further elastically deformed, the tact switch 13 is pushed by the switch pushing convex portion 11*c* so that this switch is turned on.

When a force pushing the push button portion 11*b* is released, the arm portion 11*a* elastically deformed is returned to its original position. As a result, the switch pushing convex portion 11*c* leaves the tact switch 13 so that the tact switch 13 is turned off.

If this kind of switch structure is applied to an individual call signal receiver, for example, a substrate and the like are arranged below an indication panel, and therefore in many cases, a battery is contained downward of the push button portion 11*b*.

In the individual call signal receiver in which a battery is contained downward of the push button portion 11*b* as described above, if it is intended to reduce the thickness of the case 12, a strong force is required for an operation of the push button portion 11*b*.

This reason is that in the individual call signal receiver having such a structure, if the thickness of the case 12 is reduced, the conventional switch structure shown in FIG. 1 is applied, so that the switch portion is arranged beside of the battery. At this time, there is no sufficient gap in the horizontal and vertical directions, so that the length of the arm portion 11*a* cannot be obtained sufficiently. Thus, when the push button portion 11*b* is pushed down, the arm portion 11*a* indicates a behavior like a rigid structure, so that the motion of the push button portion 11*b* requires a strong force.

On the contrary, if it is intended to weaken a force required for the operation of the push button portion 11*b*, in the individual call signal receiver in which a battery is contained downward of the push button portion 11*b*, there is no way but locating a switch between the push button portion 11*b* and the battery. Thus, the thickness of the case 12 must be increased.

As a switch capable of satisfying these two contradictory requirements, for example a key board switch has been known. However, this kind of switch costs too much.

SUMMARY OF THE INVENTION

Accordingly, an object of the present invention is to provide a switch structure of an electronic device coping with miniaturization of electronic devices.

Another object of the present invention is to provide a switch structure of an electronic device which can be produced at small cost.

According to the present invention, there is provided a switch structure of an electronic device, comprising: a case having supporting convex portions, switches mounted within the case, and a push button containing arm portions elastically deformable, push button portions, and a switch pushing convex portion provided on an end of a surface of each push button portion, wherein one end of each arm portion which is far from each push button portion is fixed to the case, each supporting convex portion is provided so as to contact a position nearer each arm portion relative to a center of each push button portion, on the surface of each push button portion during the operation of each push button portion, and each switch pushing convex portion actuates each switch when the operation of each push button portion has terminated.

DESCRIPTION OF THE PREFERRED EMBODIMENTS

A preferred embodiment of the present invention will be described with reference to FIGS. 2–5. Of course, the present invention is not restricted to this embodiment.

Figure 1:
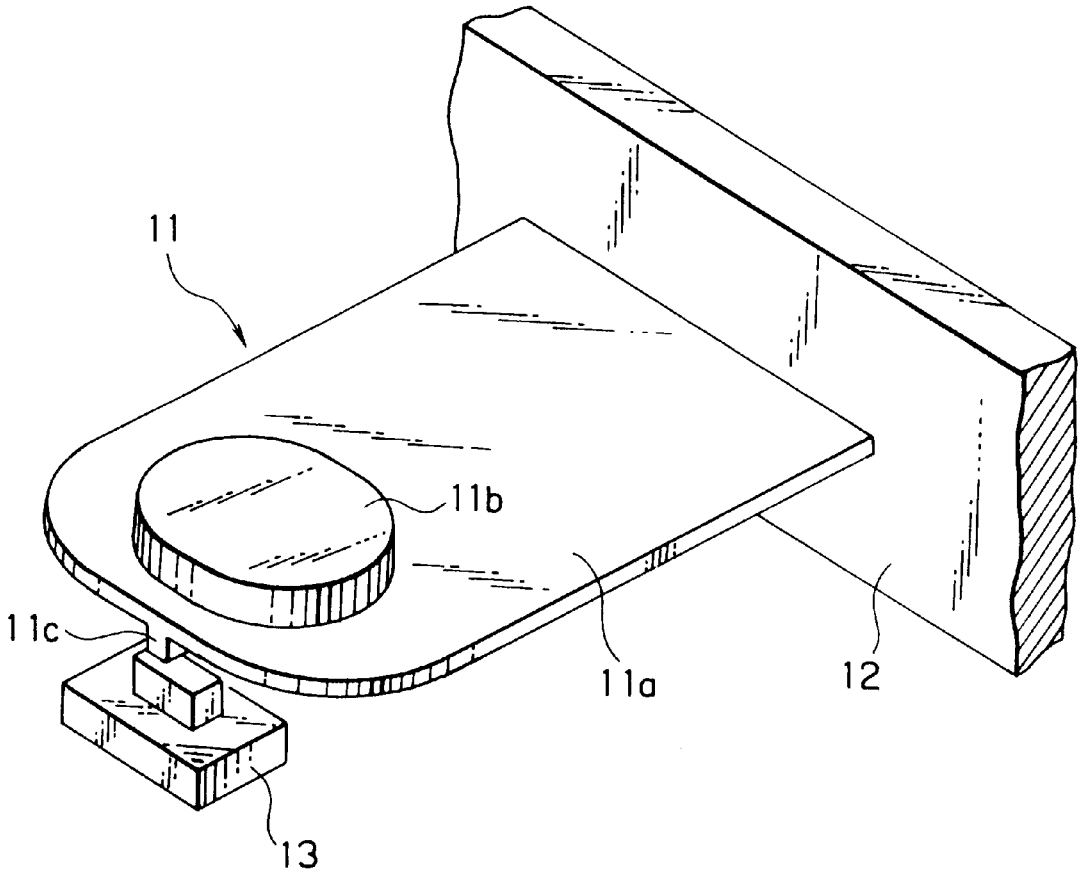
FIG. 1 PRIOR ART
FIG. 1 is a perspective view of an example of a switch structure of a conventional electronic device.
Figure 2:
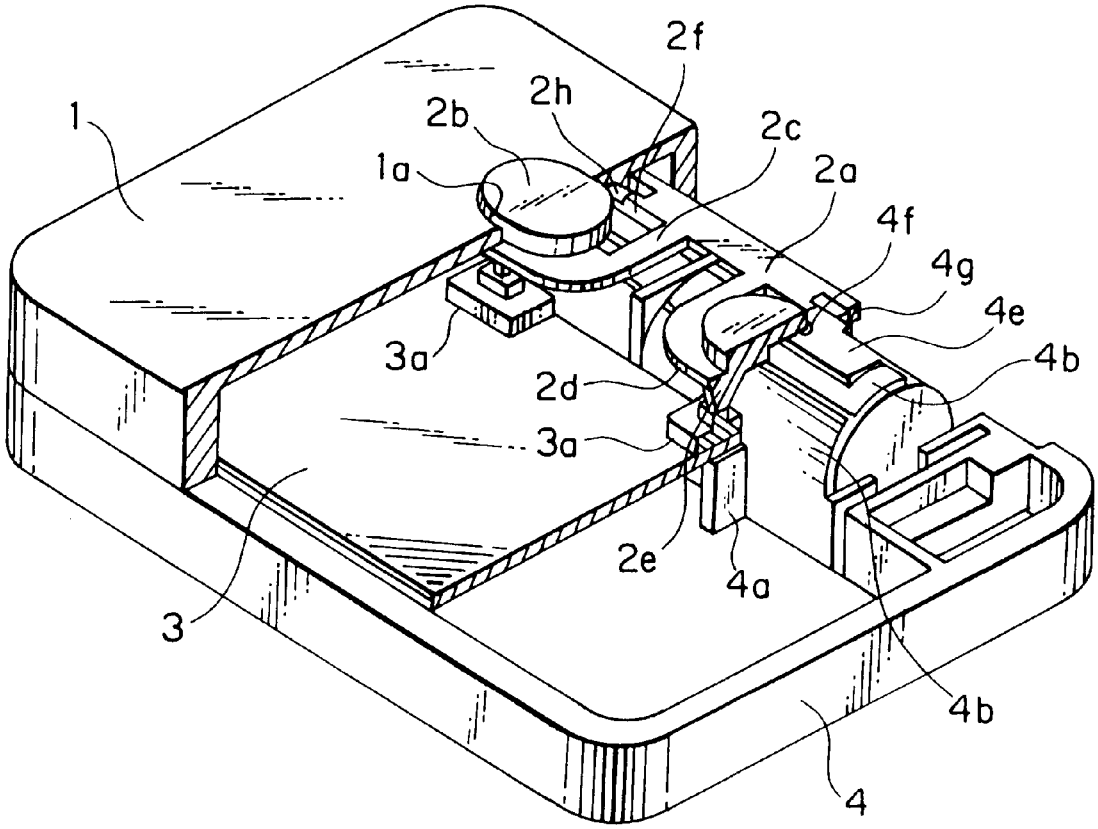
FIG. 2 is a perspective view of an individual call signal receiver using a switch structure of an electronic device according to an embodiment of the present invention. By removing part of an upper case, a push button, and a substrate, the interior of the individual call signal receiver can be seen.
Figure 3:
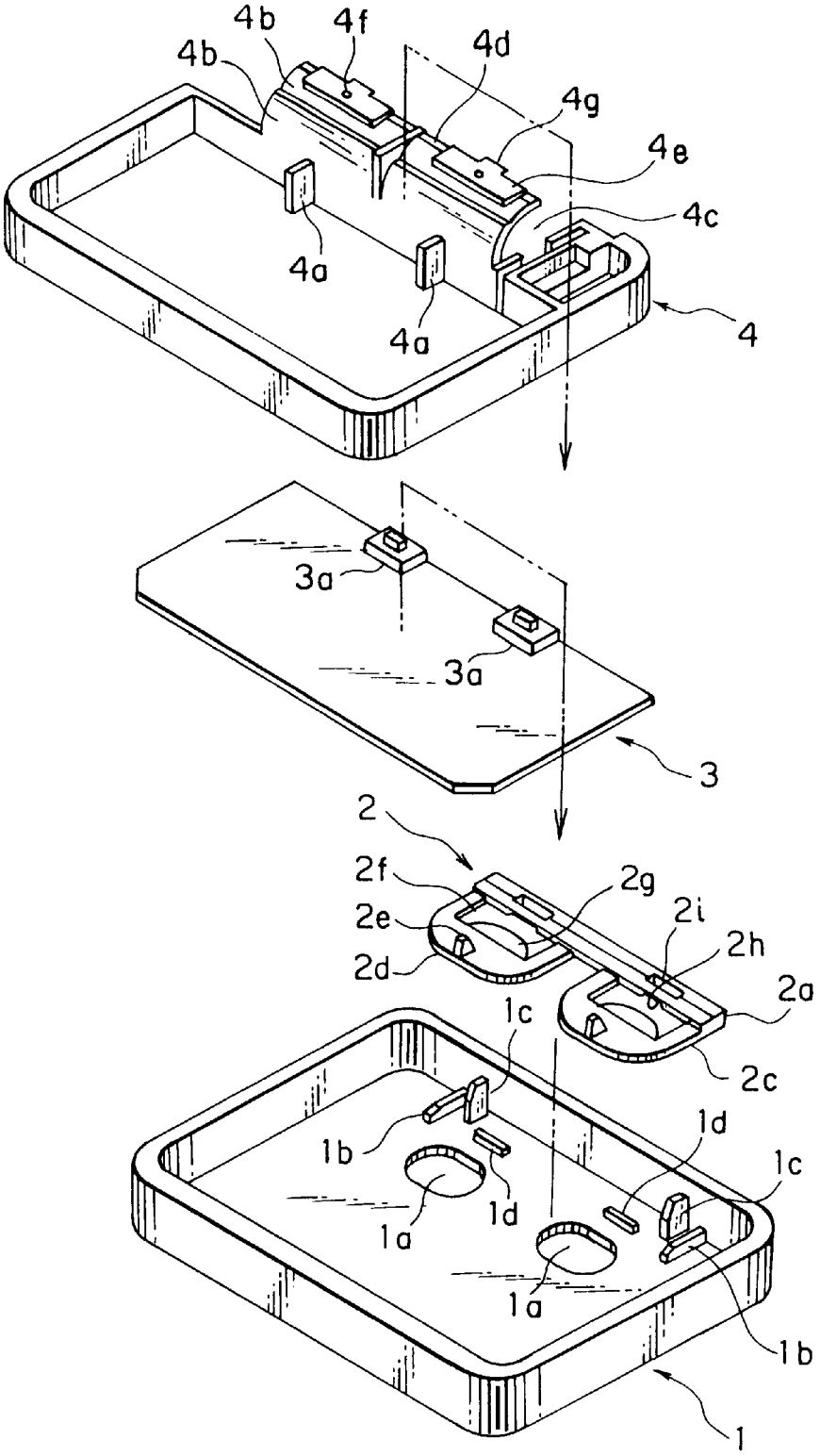
FIG. 3 is a disassembly perspective view of the individual call signal receiver using the switch structure of the electronic device according to the embodiment of the present invention. The push button and the upper case are expressed upside down.
Figure 4A:
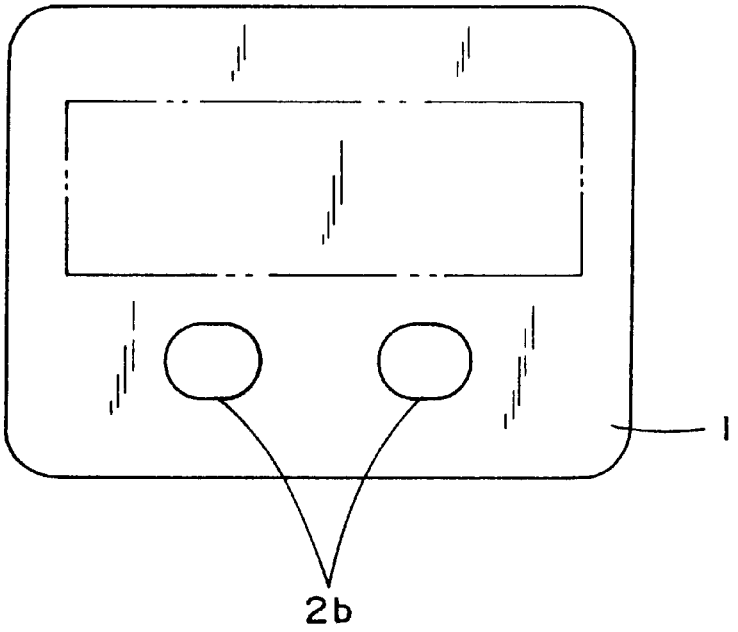
FIG. 4A is a front view of the individual call signal receiver using the switch structure of the electronic device according to the embodiment of the present invention.
Figure 4B:
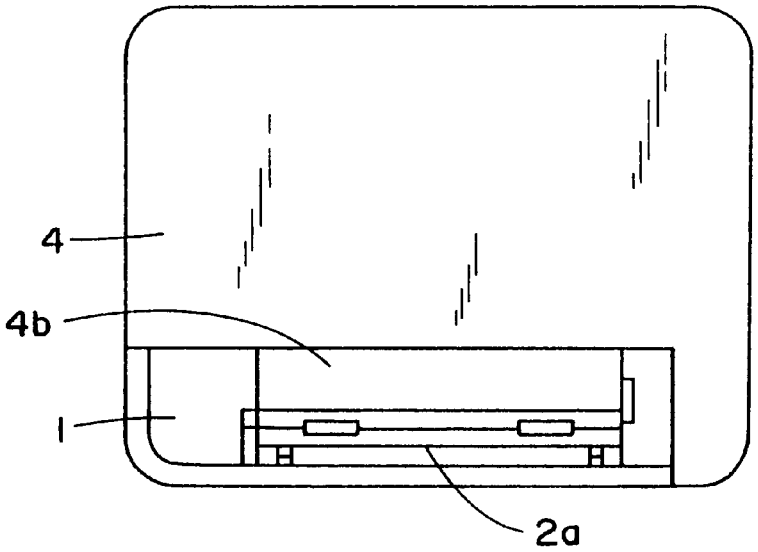
FIG. 4B is a rear view of the individual call signal receiver using the switch structure of the electronic device according to the embodiment of the present invention.

An individual call signal receiver case comprises an upper case 1 and a lower case 4 as shown in FIG. 2. As shown in FIG. 3 (a push button 2 and the upper case 1 are expressed upside down), the upper case 1 has holes 1*a*, 1*a* through which two push button portions 2*b*, 2*b* pass and ribs 1*b*, 1*c*, and 1*d*, for fixing the push button 2.

The push button 2 comprises a fixing portion 2*a* for fixing the push button 2, the push button portions 2*b*, for a user to use and arm portions 2*c*. The fixing portion 2*a* is of substantially square rod and four arm portions 2*c* are provided on one of external faces thereof. The arm portions form two pairs each comprising two arm portions. The arm portions are connected by substantially semi-circular flange portions 2*d*. As shown in FIG. 2, on top faces of the flange portions 2*d* are provided the push button portions 2*b*, 2*b* in elliptic shape of a smaller size. As shown in FIG. 3, on front ends of bottoms of the flange portions 2*d* are provided switch pushing convex portions 2*e*. Between the arm portions 2*c* are provided cutout portions 2*f*. In the cutout portions 2*f* are projected substantially half the push button portions 2*b*, and rear faces of the projected portions are push button rear faces 2*g*. Further, grooves 2*h* are provided in the middle portion of the arm portions 2*c* of the fixing portion 2*a*. Further, the fixing portion 2*a* has holes 2*i* which the ribs 1*d* of the upper case 1 enter.

On a substrate 3 are disposed switches 3*a*, such that they are arranged at the same distance as that between the switch pushing convex portions 2*e*.

Figure 5A:
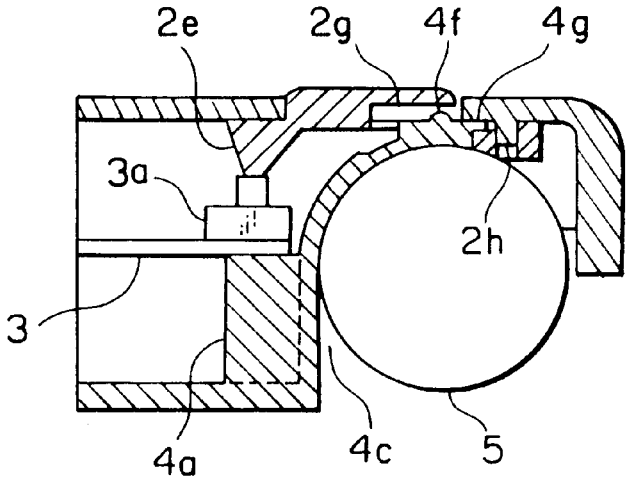
FIG. 5A is a sectional view showing a state before the operation of the push button is started in major parts of the individual call signal receiver using the switch structure of the electronic device according to the embodiment of the present invention.
Figure 5B:
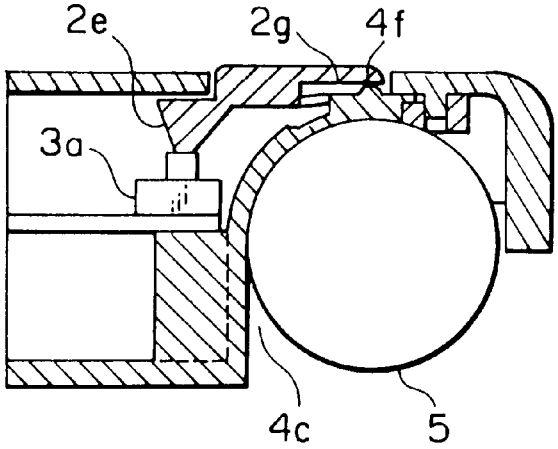
FIG. 5B is a sectional view showing a state showing halfway of the operation of the push button in major parts of the individual call signal receiver using the switch structure of the electronic device according to the embodiment of the present invention.
Figure 5C:
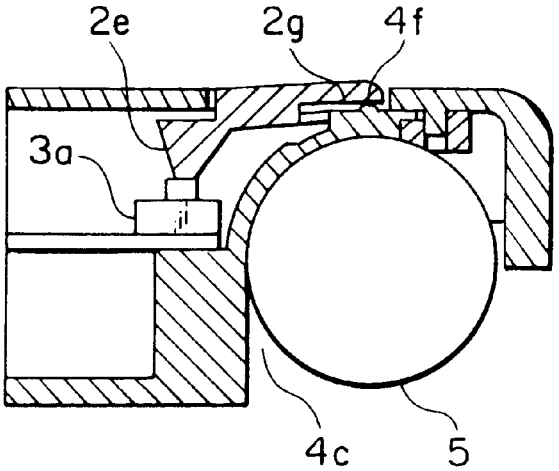
FIG. 5C is a sectional view showing a state showing that the operation of the push button has terminated in major parts of the individual call signal receiver using the switch structure of the electronic device according to the embodiment of the present invention.

The lower case 4 has ribs 4*a* for supporting the switches 3*a* of the substrate 3 from below. A part of the lower case 4 is partitioned by a battery mounting wall 4*b*, and as shown in FIGS. 5A–5C, a battery 5 is mounted in the battery mounting chamber 4*c*. An end portion of the battery mounting wall 4*b* acts as a supporting point portion 4*d* and dust proof convex portions 4*e* which can be contained in the cutout portions 2*f*, 2*f* are provided near a portion of the battery mounting wall 4*b* which is in contact with the fixing portion 2*a* of the push button 2. On each top face of the dust proof convex portions 4*e* is provided a semi-spherical supporting convex portion 4*f*. Further, each portion of the dust proof convex portions 4*e* is formed as a tab 4*g* projecting out from an end of the battery mounting wall 4*b*.

Referring to FIGS. 2 and 3, relations of the respective components will be described further in detail.

The holes 1*a* are slightly larger than the push button portions 2*b* and smaller than the flange portions 2*d*. As a result, foreign matter cannot enter the interior of the case easily.

The ribs 4*a* support the switches 3*a* from below so that even when the switch pushing convex portions 2*e* push the switches 3*a*, the substrate 3 is not warped.

The tab 4*g* of the lower case 4 engage the grooves 2*h* of the push button 2. Thus, the push button 2 can be fixed further firmly to the lower case 4. Thus, when the push button portions 2*b* are operated, the battery mounting wall 4*b* never rides over the fixing portion 2*a* of the push button 2.

On the battery mounting wall 4*b* of the lower case 4 are provided the dust proof convex portions 4*e* which are slightly smaller than the cutout portions 2*f* of the push button 2 not so as to produce an obstacle against the motion of the push button 2 when the push button 2 is installed on the lower case 4. As a result, foreign matter cannot enter the interior of the case easily.

Next, an operation of the push button 2 will be described with reference to FIG. 5.

FIG. 5A is a sectional view of the push button 2 showing a state before the push button 2 is operated. The lower case 4 disposed behind the switch 3*a* of the substrate 3 has the ribs 4*a* to prevent the substrate 3 from being warped when the push button portion 2*b* of the push button 2 is pushed. There is a slight gap between the push button rear face 2*g* of the push button 2 and the supporting convex portion 4*f* of the lower case 4.

FIG. 5B is a sectional view showing a state in which the push button 2 is being pushed. When the push button portion 2*b* is pushed down, the push button portion 2*b* is lowered vertically, so that the push button rear face 2*g* comes into contact with the supporting convex portion 4*f*. Even if this state is reached, the switch 3*a* is not actuated.

FIG. 5C is a sectional view showing a state in which the operation of the push button 2 terminates. If the push button portion 2*b* is pushed further down, the push button 2 is moved as if it rotates with a contact point between the push button rear face 2*g* and the supporting point convex portion 4*f* of the lower case 4 as a fulcrum. Then, the switch pushing convex portion 2*e* pushes the switch 3*a* so that the switch 3*a* is turned on.

If a force applied to the push button portion 2*b* is released, the push button portion 2*b* is returned to its original position by the elasticity of the arm portions 2*c*.

In this individual call signal receiver, when the push button portion 2*b* is pushed, the arm portions 2*c* are elastically deformed with the supporting point portion 4*d* in contact with the fixing portion 2*a* as a fulcrum, so that the push button portion 2*b* is lowered. However, since the push button rear face 2*g* comes into contact with the supporting convex portion 4*f* of the lower case 4, the push button portion 2*b* acts with this contact point as a fulcrum. Thus, the side of the cutout portion 2*f* of the push button portion 2*b* is prevented from being depressed too much, so that the switch 3*a* can be pushed with a short stroke. At this time, the shorter a distance between the supporting point portion 4*d* and the supporting convex portion 4*f*, the more preferable because a distance between the push button portion 2*b* and the supporting convex portion 4*f* can be extended more. With such a structure, the push button 2 of the individual call signal receiver can be operated at a weak pushing force and at the same time, the individual call signal receiver can be formed in small and thin structure.

Because the supporting convex portion 4*f* is provided on top face of the battery mounting wall 4*b*, a space inside the case can be effectively used.

What is claimed is:

1. A switch structure of an electronic device comprising:

a case having a supporting convex portion on a surface thereof;

a push button fixed to the case and having a push button portion, a switch pushing convex portion, and at least one elastically deformable arm portion for retaining the push button between an actuation position when the push button portion is depressed and a non-actuation position when the push button portion is not depressed;

a switch disposed in the case and aligned with the switch pushing convex portion of the push button such that the switch is activated by the switch pushing convex portion when the push button portion is depressed to the activation position;

whereby the push button rotates about the supporting convex portion to the activation position and returns to the nonactivation position by the elasticity of the arm portion.

2. The switch structure of claim 1, wherein the case further comprises a battery mounting chamber and the supporting convex portion is provided on a surface of the battery mounting chamber.

3. The switch structure of claim 2, wherein the push button is fixed to the case by engagement between a groove disposed on the push button and a corresponding tab disposed on the battery mounting chamber.

4. The switch structure of claim 3, wherein the push button has two arm portions and further comprising a dust proof convex portion disposed on the surface of the battery mounting chamber between the two arm portions.

5. The switch structure of claim 2, wherein the case comprises an upper case and a lower case, the lower case having ribs for fixing the push button thereon and a hole in which the push button is disposed, the upper case having the battery mounting chamber.

6. The switch structure of claim 1, wherein the switch is fixed to one surface of a substrate disposed in the case, and wherein the case further has a rib for supporting the substrate thereon, the rib being positioned such that it opposes the switch.

7. The switch structure of claim 1, wherein the switch, push button, and supporting convex portion are provided in plurality so as to be arranged adjacent to one another.

* * * * *